US007793720B2

(12) United States Patent
Dreher, Jr. et al.

(10) Patent No.: US 7,793,720 B2
(45) Date of Patent: Sep. 14, 2010

(54) PRODUCER WELL LUGGING FOR IN SITU COMBUSTION PROCESSES

(75) Inventors: Wayne Reid Dreher, Jr., Katy, TX (US); Wendell Peter Menard, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 67 days.

(21) Appl. No.: 12/328,344

(22) Filed: Dec. 4, 2008

(65) Prior Publication Data

US 2010/0139915 A1 Jun. 10, 2010

(51) Int. Cl.
*E21B 43/243* (2006.01)

(52) U.S. Cl. ..... 166/272.1; 166/260

(58) Field of Classification Search ..... None
See application file for complete search history.

(56) References Cited

U.S. PATENT DOCUMENTS

| | | | |
|---|---|---|---|
| 3,116,792 | A | 1/1964 | Purre |
| 3,978,920 | A | 9/1976 | Bandyopadhyay et al. |
| 4,726,759 | A | 2/1988 | Wegener |
| 4,993,490 | A | 2/1991 | Stephens et al. |
| 5,055,030 | A | 10/1991 | Schirmer |
| 5,211,230 | A | 5/1993 | Ostapovich et al. |
| 5,339,897 | A | 8/1994 | Leaute |
| 5,456,315 | A | 10/1995 | Kisman et al. |
| 5,626,191 | A | 5/1997 | Greaves et al. |
| 6,412,557 | B1 | 7/2002 | Ayasse et al. |
| 6,918,444 | B2 | 7/2005 | Passey et al. |
| 2005/0082057 | A1 | 4/2005 | Newton et al. |
| 2008/0169096 | A1 | 7/2008 | Ayasse |

FOREIGN PATENT DOCUMENTS

| | | | |
|---|---|---|---|
| WO | WO 2008/070990 | A1 | 6/2008 |

*Primary Examiner*—Zakiya W. Bates

(57) ABSTRACT

Methods and apparatus relate to controlling location of inflow into a production well during in situ combustion. The production well includes intervals closable to the inflow at identified times. Once a combustion front from the in situ combustion passes one of the intervals, a blockage conveyed from surface into the production well forms a barrier to the inflow at the interval that has been passed by the combustion front. An example of the blockage includes a cement plug delivered through coiled tubing into the production well, which may include production tubing that defines the intervals based on at least two consecutive alternating lengths of solid wall sections and slotted or perforated sections of the production tubing.

20 Claims, 4 Drawing Sheets

PRODUCER WELL LUGGING FOR IN SITU COMBUSTION PROCESSES

CROSS-REFERENCE TO RELATED APPLICATIONS

None

STATEMENT REGARDING FEDERALLY SPONSORED RESEARCH OR DEVELOPMENT

None

FIELD OF THE INVENTION

Embodiments of the invention relate to methods and systems for oil recovery with in situ combustion.

BACKGROUND OF THE INVENTION

In situ combustion offers one approach for recovering oil from reservoirs in certain geologic formations. With in situ combustion, an oxidant injected into the reservoir reacts with some of the oil to propagate a combustion front through the reservoir. This process heats the oil ahead of the combustion front. Further, the injection gas and combustion gas products drive the oil that is heated toward an adjacent production well.

Success of in situ combustion depends on stability of the combustion front. For maximum recovery of the oil, the combustion front must be able to stay ignited in order to sweep across the entire reservoir above a horizontal portion of the production well. Prior approaches often result in instability of the combustion front or even premature extinguishing of the combustion front.

Therefore, a need exists for improved methods and systems for oil recovery with in situ combustion.

SUMMARY OF THE INVENTION

In one embodiment, a method of performing oil recovery with in situ combustion includes conducting the in situ combustion in a geologic formation and flowing products into a production well from the formation. The products enter the production well along a first portion of the production well where inflow of the products is permitted. In addition, the method includes operating a device disposed within the production well to create an obstruction to the inflow at the first portion while leaving a second portion of the production well open to the inflow of the products.

According to one embodiment, a method enables performing oil recovery with in situ combustion. The method includes conducting the in situ combustion in a geologic formation, recovering liquid hydrocarbons through a production well during the in situ combustion, and controlling breakthrough of oxidants for the in situ combustion into the production well at locations along the production well where a flow path for the oxidants bypasses a combustion front of the in situ combustion. An operation performed during the in situ combustion provides the controlling that is independent of naturally occurring processes during the in situ combustion.

For one embodiment, a method of performing oil recovery with in situ combustion includes injecting oxidant into an injection well to establish a combustion front of ignited oil within a geologic formation. Propagation of the combustion front through the formation facilitates obtaining products. The products flow through a production well having first and second portions that permit inflow of the products from the formation into the production well. The method further includes obstructing the inflow through the first portion of the production well with a blockage conveyed from surface into the production well, wherein inflow of the products through the second portion occurs after obstructing the first portion.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to controlling location of inflow into a production well during oil recovery with in situ combustion. The production well includes longitudinal intervals closable to the inflow at different identified times. Once a combustion front from the in situ combustion comes into proximity with one of the intervals or passes one of the intervals, a blockage conveyed from surface into the production well forms a barrier to the inflow at the interval that has come into proximity with, or been passed by, the combustion front. An example of the blockage includes a cement plug delivered through coiled tubing into the production well, which may include production tubing that defines the intervals based on at least two consecutive alternating lengths of solid wall sections and slotted or perforated sections of the production tubing.

Figure 1:
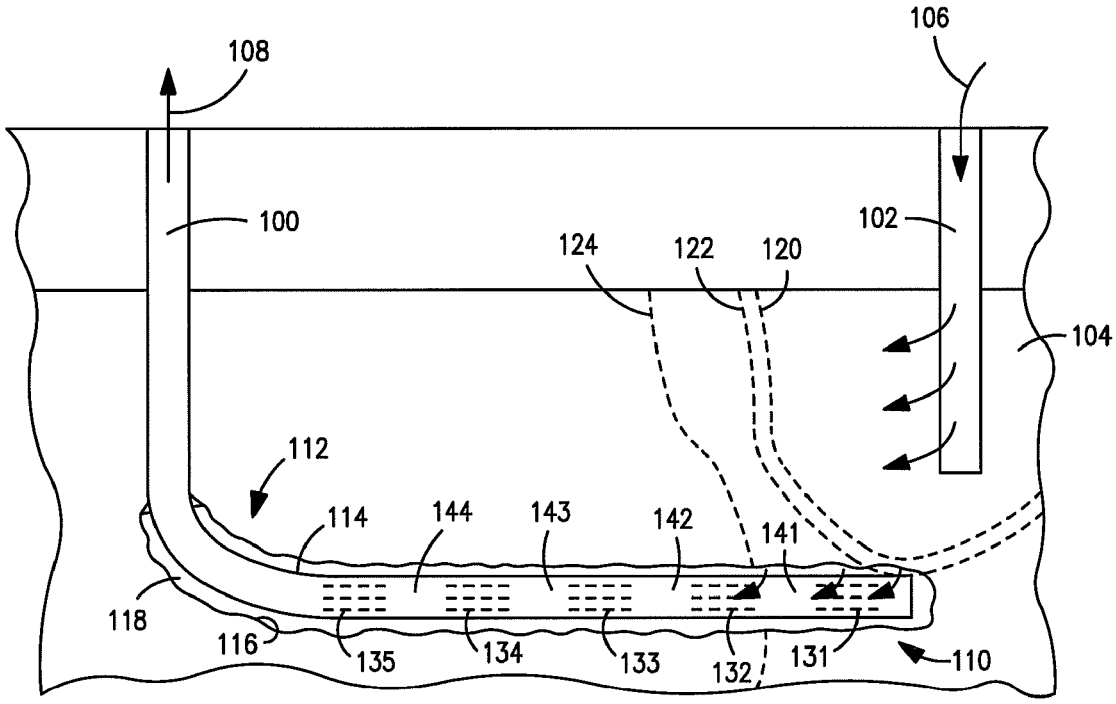
FIG. 1 is a schematic sectional view of an injection well and production well after commencing in situ combustion, according to one embodiment of the invention.
Figure 4:
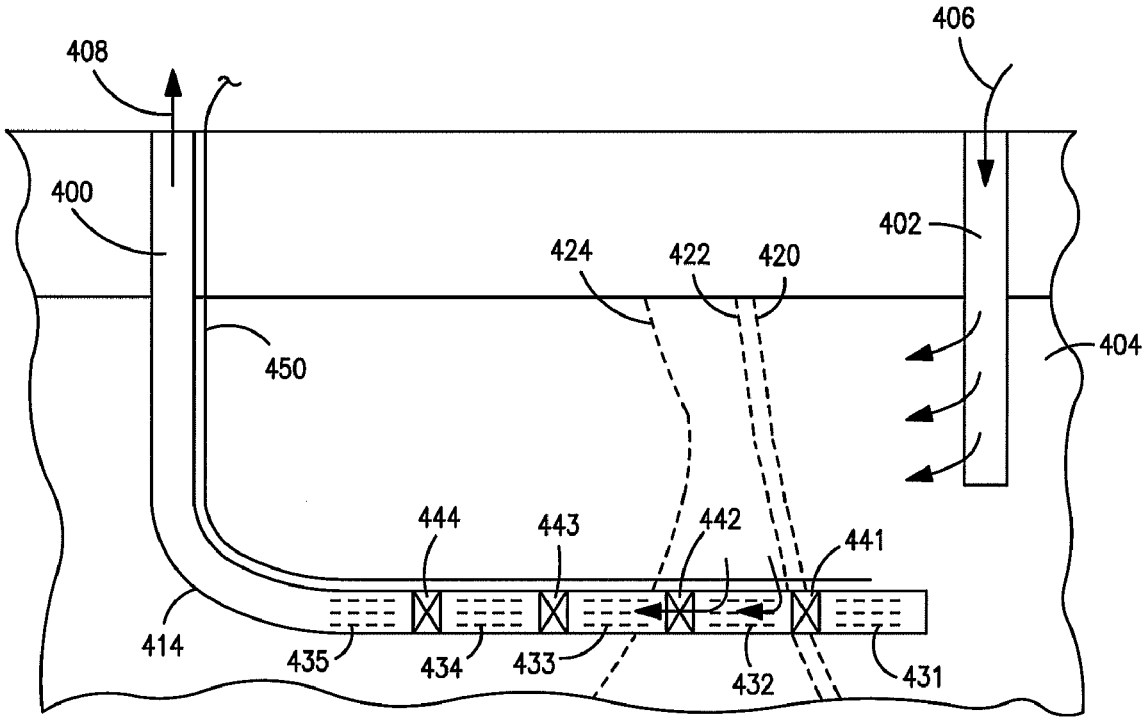
FIG. 4 is a schematic sectional view of injection and production wells showing staged flow control devices disposed along the production well for successive activation during in situ combustion, according to one embodiment of the invention.

FIG. 1 illustrates a production well 100 and an injection well 102 that are each defined by boreholes drilled to intersect an oil bearing formation 104. In operation, an oxidant 106 is injected into the formation 104 via the injection well 104 and an oil production flow 108 is recovered through the production well 100. Orientation, type of completion, and number of the production and injection wells 100, 102 may depend on particular geologic characteristics of the formation 104. Vertical orientation of the injection well 102 terminating above and proximate a toe 110 of a horizontal portion of the production well 100 exemplifies one embodiment suitable for in situ combustion, which propagates toward a heel 112 of the production well 100. Further, the production well 100 includes tubing string 114 disposed along the horizontal portion within open-hole 116. While some embodiments (e.g., as shown in FIG. 4) may utilize cemented in place tubing, an annulus 118 between the open-hole 116 and the tubing string 114 defines an air gap.

Sufficient proximity of the toe 110 of the production well 100 to the injection well 100 ensures fluid communication between the injection well 102 and the production well 100 as needed for the in situ combustion. In particular, the production well 100 evacuates combustion gasses and the oil in the formation 104 as the oil is heated and becomes mobile. Without the evacuation of these products, progression of the in situ combustion stops. Preheating the formation 104 around the injection well 102 with steam, for example, may facilitate in establishing initial communication between the injection well 102 and the production well 100.

The in situ combustion begins by introducing the oxidant 106 into the injection well 102. Examples of the oxidant 106 include oxygen or oxygen-containing gas mixtures. The in situ combustion generates a combustion front 120, which may be between about 0.1 meters (m) and about 0.3 m across and is shown at a first stage after having progressed some distance away from the injection well 102. Ahead of the combustion front 120 is a steam zone 122. A mobile oil zone extends between the steam zone 122 and a transition boundary 124 defined by where the oil is too cold and viscous to flow through the formation 104.

At the first stage of the in situ combustion depicted in FIG. 1, the mobile oil flows through a first slotted wall section 131 of the tubing string 114 located closest to the toe 110 and thereby the injection well 102. The combustion front 120 is not past the first slotted wall section 131 at the first stage. While the transition boundary 124 intersects a second slotted wall section 132, oil flow may pass into the tubing string 114 through third, fourth and fifth slotted wall sections 133, 134, 135 of the tubing string 114 only as a result of any possible flow through the annulus 118. In some embodiments, the slotted wall sections 131-135 are separated from one another by respective first, second, third and fourth solid wall sections 141, 142, 143, 144 of the tubing string 114.

Actual number of the slotted and solid wall sections 131-135, 141-144 may vary for any particular application. Length of each of the slotted and solid wall sections 131-135, 141-144 may correspond to one or more joints of tubing (e.g., about 9 meters). The solid wall sections 141-144 define a solid continuous circumference of the tubing string 114 along the length of each of the solid wall sections 141-144. Flow paths through apertures in a circumference of the slotted wall sections 131-135 permit flow from outside the tubing string 114 to an interior of the tubing string 114. As described further herein, the tubing string 114 may thereby define intervals closable to the inflow at defined longitudinal locations spaced from one another.

Figure 2:
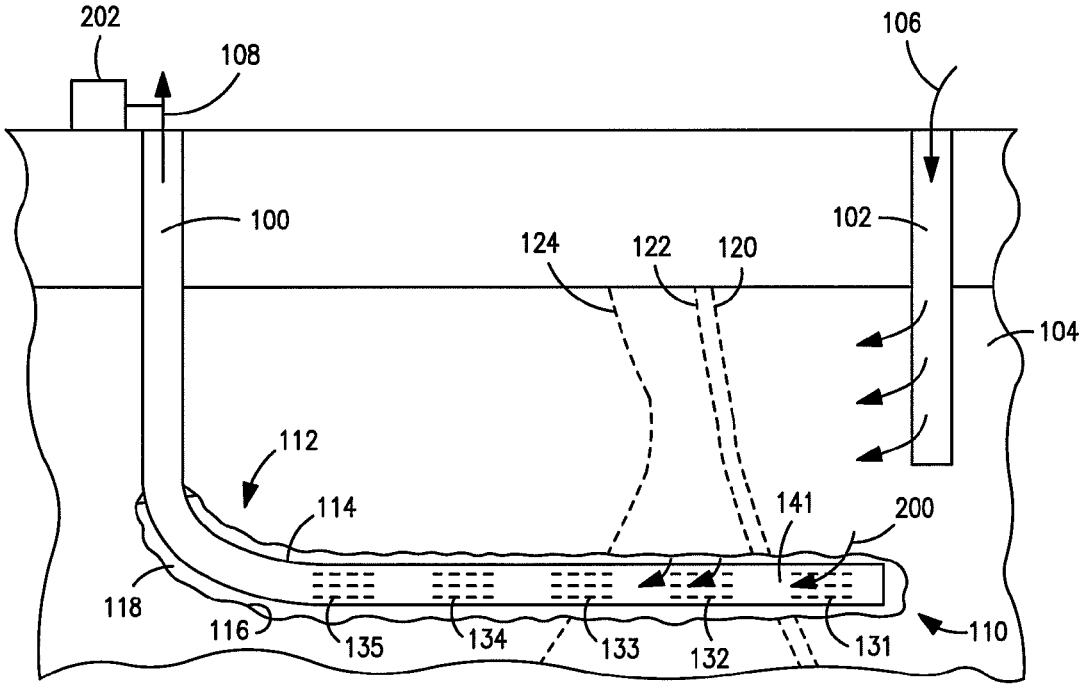
FIG. 2 is a schematic sectional view of the wells shown in FIG. 1 illustrating short circuiting of injected oxidant into the production well at a later stage of the in situ combustion, according to one embodiment of the invention.

FIG. 2 shows a second stage of the in situ combustion with the combustion front 120 having progressed through the formation 104 toward the heel 112 of the production well 100. Clean sands occupy space between the combustion front 120 and the injection well 102. The first slotted wall section 131 of the tubing string 114 extends into the clean sands of the formation 104. Due to this location of the first slotted wall section 131, the clean sands provide a short flow path for the oxidant 106 and other combustion or flue gasses (e.g., $CO_2$, CO) to the producer well 100 with less resistance to flow than a longer flow path to the combustion front 120. Since the oxidant 106 and the flue gasses tend to travel the flow path of least resistance, short circuiting (illustrated by arrow 200) of the oxidant 106 and the flue gasses into the production well 100 can occur at the second stage of the in situ combustion.

Failure of some or all of the oxidant 106 to reach the combustion front 120 due to the short circuiting can create instability of the combustion front 120. Further, the short circuiting burdens oil handling and recovery processes due to increased levels of the oxidant 106 and the flue gasses into the production flow 108 since the oxidant 106 and the flue gasses wasted from short circuiting must be separated from oil in the production flow 108. Fluid flow through the first slotted wall section 131 of the tubing string 114 may also result in undesired increased sand production via the production well 100. While oil in the formation 104 inhibits sand flow, the clean sand that is not held together by the oil in the formation 104 tends to flow into the tubing string 114. Sand produced with the production flow 108 increases erosion of equipment and also adds to the burden of oil handling and recovery processes due to added costs to remove and dispose of the sand.

As is believed, burnt oil, or coke, naturally deposits on the production well 100 as the combustion front 120 passes over a length of the production well 100. This naturally occurring deposition of the coke can tend to inhibit some of the short circuiting. However, the short circuiting can continue to present problems due to lack of adequate sealing by the deposition of the coke alone without some further operable mechanisms to block and seal progressive lengths of the tubing string 114.

In some embodiments, detection equipment 202 may analyze the production flow 108 from the production well 100 to detect the short circuiting. Measuring increases in levels of flue gasses, oxidant, and/or sand relative to oil being produced provides an indication that short circuiting is occurring. Operations described herein to block the short circuiting may start once determined based on readings from the detection equipment 202 that the combustion front 120 has progressed to a point beyond the first slotted wall section 131. For some embodiments, proactive blocking of intervals along the production well 100 may occur prior to the combustion front 120 having passed the first slotted wall section 131. Reservoir based calculations and/or temperature profiles along the production well 100 may facilitate in making decisions regarding such proactive blocking.

Figure 3:
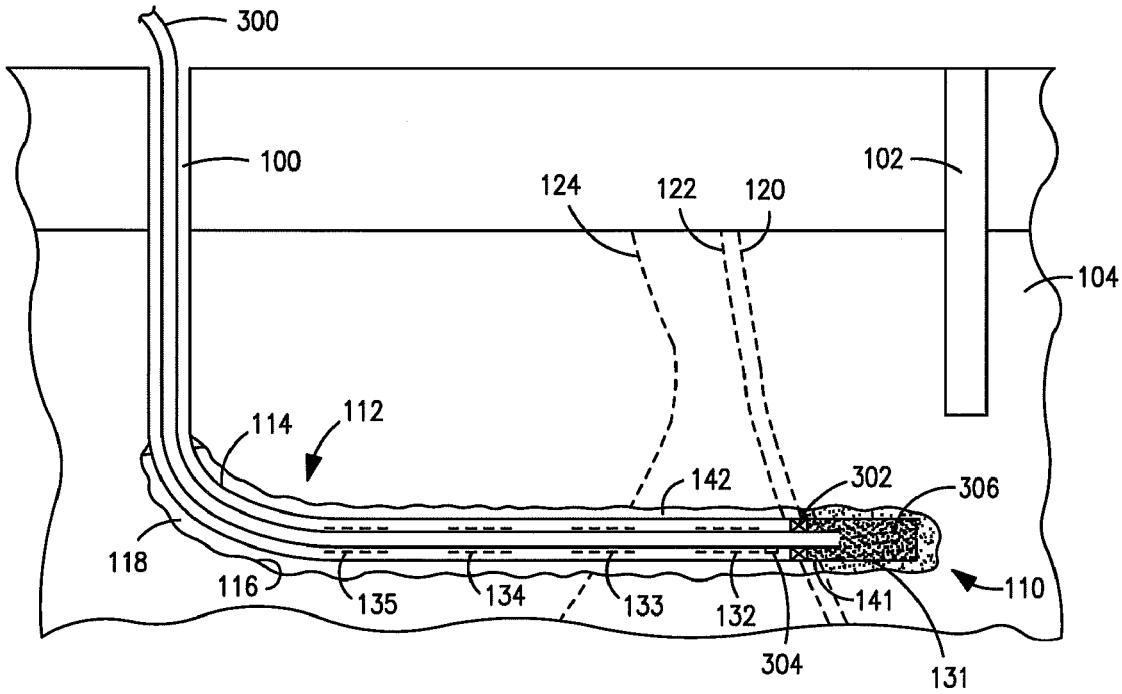
FIG. 3 is a schematic sectional view of the production well during a cementing operation to block the short circuiting, according to one embodiment of the invention.

FIG. 3 illustrates a cementing operation to block off the tubing string 114 extending toward the toe 110 beyond the first solid wall section 141. Production may temporarily cease during the cementing operation. In operation, coiled tubing runs through the tubing string 114 such that a cement retainer 302 is disposed inside the first solid wall section 141 of the tubing string 114. Once the cement retainer 302 is set, cement 306 pumped through the coiled tubing 300 fills the first slotted wall section 131. Some of the cement 306 may pass though the apertures of the slotted wall section 131 to fill an area of the annulus 118 outside of the first slotted wall section 131. While possible to introduce the cement 306 into the annulus 118, the open-hole 116 may collapse around the tubing string 114 enough to prevent flow through the annulus 118 without the cement 306 being present in the annulus 118. Disengaging the coiled tubing 300 from the cement retainer 302 permits retrieval of the coiled tubing 300 while leaving the cement retainer 302 in place as the cement 306 cures. The cement 306 seals the first slotted wall section 131 and prevents flow from the formation 104 into the first slotted wall section 131.

The combustion front 120 creates a discrete peak in temperature at where the combustion front 120 intersects length of the production well 100 corresponding to the 0.1 m to 0.3 m across that the combustion front 120 extends. Temperature falls, as a function of distance away from the combustion zone 120, from about 600° C. to about 300° C. in the steam zone 122. For some embodiments, a temperature probe 304 disposed on the coiled tubing 300 detects temperature as the coiled tubing is run into the production well 100. A temperature profile of the production well 100 can help identify location of the combustion front 120 in order to know how much of the production well 100 to block with the cement 306. For example, the cementing can begin in the second solid wall section 142 if the temperature profile indicates that the combustion front 120 has already passed the second slotted wall section 132.

After cementing the first slotted wall section 131, production continues through the second slotted wall section 132. Further, injection through the injection well 102 propagates the combustion front 120 without short circuiting via the first slotted wall section 131. Repeating cycles of production and subsequent cementing processes, as described for the first solid and slotted wall sections 131, 141, at successive ones of the slotted and solid walled sections 132-135, 142-144 occurs as the combustion front 120 advances toward the heel 112 of the production well 100. This blocking and sealing progressive lengths of the tubing string 114 prevents short circuiting throughout production and ensures that the combustion front 120 remains stable to sweep all of the formation 104 above the production well 100.

FIG. 4 shows various additional aspects that may be employed in any combination with one another or any other techniques disclosed. Common to other in situ combustion processes, a production well 400 and an injection well 402 extend into an oil bearing formation 404. In some embodiments, a tubing string 414 cemented in place from a terminus of the production well 400 to surface defines a flow path for production flow 408 through the production well 400. An oxidant introduced 406 through the injection well 402 enables ignition of oil in the formation 404 and propagation of a combustion front 420 that establishes a steam zone 422 and a mobile oil transition zone 424 respectively further away from the combustion front 420 relative to the injection well 402.

Since the tubing string 414 may be cemented in place, perforating can produce apertures in the tubing string 414 and surrounding cement to create flow paths from the formation 404 into the tubing string 414. Selecting location for the perforating creates first, second, third, fourth and fifth perforated sections 431-435. First, second, third, and fourth flow control devices 441-444 selectively seal off inflow beyond respective ones of the second, third, fourth, and fifth perforated sections 432-435. Examples of mechanical devices suitable for the flow control devices 441-444 include valves, such as flapper or ball type valves that obstruct a bore of the tubing string 414. Given temperatures and a corrosive environment experienced in the production well 400, the flow control devices 441-444 may utilize ceramic sealing surfaces. For some embodiments, the tubing string 414 may not be cemented and perforated after being run in but rather equipped with sliding sleeve type valves as the flow control devices 441-444 that are operable to close apertures through walls of corresponding ones of the first, second, third, and fourth perforated sections 431-444.

For some embodiments, the production well 400 includes an instrumentation and/or control line 450. While shown outside the tubing string 414, the line 450 may run inside the tubing string 414 to further protect the line 450 from thermal or physical damage. The line 450 may provide temperature information along the production well 400 from discrete sensors or via distributed temperature sensing using fiber optics within the line 450. This temperature data can trigger automatic actuation of the flow control devices 441-444 once temperature reaches a preset value (e.g., above 400° C.) adjacent a particular one of the flow control devices 441-444 to be actuated. The temperature data obtained with the control line 450 can further signal location of the combustion front 420 to assess timing for manual actuation of the flow control devices 441-444 or the cementing operation described with respect to FIGS. 1-3. The line 450 may supply signals from surface to the flow control devices 441-444 to actuate the flow control devices 441-444 when desired.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method of performing oil recovery with in situ combustion, comprising:

injecting oxidant into an injection well to establish a combustion front of ignited oil within a geologic formation;

flowing products through a production well having first and second portions that permit inflow of the products from the formation into the production well, wherein propagation of the combustion front through the formation facilitates obtaining the products; and obstructing the inflow through the first portion of the production well with a blockage conveyed from surface into the production well, wherein inflow of the products through the second portion occurs after obstructing the first portion.

2. The method according to claim 1, wherein the obstructing occurs after the combustion front has passed by the first portion.

3. The method according to claim 1, wherein the injection well is vertical and the production well defines a horizontal length.

4. The method according to claim 1, wherein the injection well is vertical and the production well defines a horizontal length that extends toward the injection well from a heel to a toe of the production well.

5. The method according to claim 1, wherein the blockage comprises cement.

6. The method according to claim 1, wherein the blockage comprises a mechanical flow blocking device.

7. The method according to claim 1, wherein the obstructing occurs automatically based on a sensed condition associated with the production well.

8. A method of performing oil recovery with in situ combustion, comprising:

conducting the in situ combustion in a geologic formation;

recovering liquid hydrocarbons through a production well during the in situ combustion; and controlling breakthrough of oxidants for the in situ combustion into the production well at locations along the production well where a flow path for the oxidants bypasses a combustion front of the in situ combustion, wherein the liquid hydrocarbons are recovered through the production well before and after the controlling, which is provided by an operation performed during the in situ combustion and is independent of naturally occurring processes during the in situ combustion.

9. The method according to claim 8, wherein the locations where the controlling occurs are disposed in areas of the formation already burned.

10. The method according to claim 8, wherein the controlling comprises obstructing inflow along longitudinal intervals of the production well at different times.

11. The method according to claim 8, wherein the controlling comprises obstructing inflow along longitudinal intervals of the production well successively at further distances from an injection well.

12. The method according to claim 8, further comprising injecting the oxidant into the formation via an injection well.

13. A method of performing oil recovery with in situ combustion, comprising:

conducting the in situ combustion in a geologic formation;

flowing products into a production well from the formation, wherein the products enter the production well along a first portion of the production well where inflow of the products is permitted; and operating a device disposed within the production well to create an obstruction to the inflow at the first portion while leaving a second portion of the production well open to the inflow of the products.

14. The method to claim 13, wherein operating the device occurs after a combustion front of the in situ combustion has passed by the first portion of the production well.

15. The method to claim 13, wherein operating the device comprises running coiled tubing into the production well and delivering cement into the first portion to form the obstruction.

16. The method to claim 13, wherein operating the device comprises closing a valve.

17. The method to claim 13, further comprising detecting temperature in the production well, wherein operating the device is based on the temperature detected.

18. The method to claim 13, wherein operating the device comprises:

running coiled tubing into the production well;

identifying location of a combustion front of the in situ combustion with a temperature sensor disposed on the coiled tubing;

locating the coiled tubing in the production well to fill with cement the production well extending beyond the combustion front toward an oxidant injection source; and delivering the cement into the production well to form the obstruction.

19. The method to claim 13, wherein the production well includes a tubing string having alternating slotted and solid wall sections and the first portion is defined by one of the slotted wall sections of the tubing string.

20. The method to claim 19, further comprising setting a cement retainer within one of the solid wall sections and filling the one of the slotted wall sections defining the first portion with cement.

* * * * *

UNITED STATES PATENT AND TRADEMARK OFFICE

CERTIFICATE OF CORRECTION

PATENT NO. : 7,793,720 B2
APPLICATION NO. : 12/328344
DATED : September 14, 2010
INVENTOR(S) : Wayne Reid Dreher, Jr. et al.

It is certified that error appears in the above-identified patent and that said Letters Patent is hereby corrected as shown below:

Title page and Col. 1

Title incorrectly printed on the face of the Letters Patent as PRODUCER WELL LUGGING FOR IN SITU COMBUSTION PROCESSES. The correct title of the patent is as follows: PRODUCER WELL PLUGGING FOR IN SITU COMBUSTION PROCESSES.

Signed and Sealed this
Fifth Day of April, 2011

David J. Kappos

David J. Kappos
*Director of the United States Patent and Trademark Office*